US010883248B2

(12) United States Patent
Stotlar

(10) Patent No.: US 10,883,248 B2
(45) Date of Patent: Jan. 5, 2021

(54) ROAD MAINTENANCE USING STORED MAINTENANCE PASSES

(71) Applicant: Deere & Company, Moline, IL (US)

(72) Inventor: Richard L Stotlar, Bettendorf, IA (US)

(73) Assignee: Deere & Company, Moline, IL (US)

( * ) Notice: Subject to any disclaimer, the term of this patent is extended or adjusted under 35 U.S.C. 154(b) by 145 days.

(21) Appl. No.: 16/166,599

(22) Filed: Oct. 22, 2018

(65) Prior Publication Data

US 2020/0123735 A1 Apr. 23, 2020

(51) Int. Cl.

| | |
|---|---|
| ***E02F 3/84*** | (2006.01) |
| ***E02F 9/26*** | (2006.01) |
| ***E02F 3/76*** | (2006.01) |
| ***E02F 9/22*** | (2006.01) |
| ***E02F 9/20*** | (2006.01) |

(52) U.S. Cl.

CPC ..... *E02F 3/845* (2013.01); *E02F 3/764* (2013.01); *E02F 9/2041* (2013.01); *E02F 9/2253* (2013.01); *E02F 9/265* (2013.01); *E02F 3/7659* (2013.01); *E02F 9/2054* (2013.01)

(58) Field of Classification Search

None

See application file for complete search history.

(56) References Cited

U.S. PATENT DOCUMENTS

| | | | |
|---|---|---|---|
| 6,845,311 | B1 | 1/2005 | Stratton et al. |
| 9,328,479 | B1 | 5/2016 | Rausch et al. |
| 9,551,130 | B2 | 1/2017 | Hendron et al. |
| 9,624,643 | B2 | 4/2017 | Hendron et al. |
| 9,809,956 | B1 | 11/2017 | Sherlock |
| 10,001,078 | B2 | 6/2018 | Green et al. |
| 2007/0235201 | A1 | 10/2007 | Gharsalli |
| 2008/0000659 | A1* | 1/2008 | Zachman ..... E02F 3/845 172/797 |
| 2013/0304331 | A1 | 11/2013 | Braunstein et al. |

(Continued)

FOREIGN PATENT DOCUMENTS

DE 102005031135 A1 3/2006

OTHER PUBLICATIONS

Gravel Roads Construction and Maintenance Guide, dated Aug. 2015, pp. 153, revised manual prepared by Federal Highway Administration and South Dakota Local Technical Assistance Program.

(Continued)

*Primary Examiner* — Richard M Camby

(57) ABSTRACT

In accordance with an example embodiment, a work vehicle may include a vehicle positioning system providing a vehicle position signal, a ground-engaging blade moveable by blade actuators, a blade sensing system providing a blade position signal, and a controller in communication with the vehicle positioning system, the blade actuators, and the blade sensing system. The controller may be configured to receive the vehicle position signal, receive the blade position signal, determine a target blade position using the vehicle position signal and a stored maintenance pass, the stored maintenance pass indicative of a past position of the blade associated with a past position of the vehicle for a plurality of past vehicle positions, and control the blade actuators to move the blade toward the target blade position.

10 Claims, 4 Drawing Sheets

(56) References Cited

U.S. PATENT DOCUMENTS

| | | | | |
|---|---|---|---|---|
| 2014/0324291 | A1* | 10/2014 | Jones | G05D 1/0278 701/41 |
| 2016/0069042 | A1 | 3/2016 | Wei et al. | |
| 2016/0122969 | A1 | 5/2016 | Noborio et al. | |
| 2016/0312446 | A1 | 10/2016 | Pettersson et al. | |
| 2017/0226717 | A1 | 8/2017 | Cherney | |
| 2017/0342684 | A1 | 11/2017 | Sherlock | |
| 2018/0061040 | A1 | 3/2018 | Beery et al. | |
| 2019/0078292 | A1* | 3/2019 | Ono | G01S 13/867 |
| 2019/0085530 | A1* | 3/2019 | Sherlock | E02F 3/765 |
| 2019/0226176 | A1* | 7/2019 | Smith | E02F 3/845 |
| 2019/0323203 | A1* | 10/2019 | Kovalick | E02F 3/8155 |

OTHER PUBLICATIONS

German Search Report issued in counterpart application No. 102019214363.6 dated Jun. 25, 2020 (06 pages).

* cited by examiner

ROAD MAINTENANCE USING STORED MAINTENANCE PASSES

TECHNICAL FIELD

The present disclosure generally relates to a method and apparatus for maintaining unpaved roads using information from the final pass of a work vehicle. An embodiment of the present disclosure relates to recording and using manual passes by a work vehicle performing unpaved road maintenance to aid in the future maintenance of that road.

BACKGROUND

Off-road work vehicles may use implements to carry out various work operations. A work vehicle such as a motor grader, for example, may have a blade referred to as a moldboard which is used to maintain an unpaved road. The motor grader may engage the road with the moldboard at varying heights and tilts to alter the surface of the road, by moving the gravel or dirt surface, to smooth the road or give it a particular shape.

During such a maintenance pass, an operator may manually control such a work vehicle to vary the moldboard height and tilt as the work vehicle travels down the road to achieve the desired final condition of the unpaved road. Such a maintenance pass may need to be completed at regular intervals and weather or usage conditions have degraded the unpaved road.

SUMMARY

Various aspects of examples of the present disclosure are set out in the claims.

According to a first aspect of the present disclosure, a work vehicle may include a vehicle position system, a ground-engage blade moveable by blade actuators, a blade sensing system, and a controller. The vehicle positioning system may be configured to provide a vehicle position signal indicative of a position of the vehicle. The blade sensing system may be configured to provide a blade position signal indicative of a position of the blade. The controller may be in communication with the vehicle positioning system, the blade actuators, and the blade sensing system. The controller may be configured to receive the vehicle position signal, receive the blade position signal, determine a target blade position using the vehicle position signal and a stored maintenance pass, and control the blade actuators to move the blade toward the target blade position. The stored maintenance pass may be indicative of a past position of the blade associated with a past position of the vehicle for a plurality of past vehicle positions. The controller may be further configured to use a plurality of vehicle position signals and a plurality of blade position signals to create a new maintenance pass, where the new maintenance pass is indicative of the position of the blade associated with the position of the vehicle for a plurality of positions of the vehicle.

The controller may determine the target blade position by selecting the blade position associated with the stored vehicle position most proximate to the current vehicle position in the stored maintenance pass. Alternatively, the controller may determine the target blade position by interpolating between the two data points in the stored maintenance pass most proximate to the current vehicle position. Alternatively, the controller may determine an estimated future vehicle position based on the current vehicle position and velocity, and determine the target blade position based on the one or two data points most proximate to the future vehicle position.

According to a second aspect of the present disclosure, a method of maintaining an unpaved road may include performing a first maintenance pass while sensing a plurality of positions of the blade and work vehicle, creating a stored maintenance record from this plurality of blade and vehicle positions, then performing a second maintenance pass of the road using the stored maintenance pass and a current position of the vehicle. The first maintenance pass may be performed on the unpaved road with a first work vehicle under the manual control of an operator, and the first maintenance pass may alter a surface of the road using a blade of the first work vehicle. The method includes sensing a plurality of positions of the blade of the first work vehicle during the first maintenance pass and sensing a plurality of positions of the first work vehicle during the first maintenance pass. Creating a stored maintenance pass includes using the sensed plurality of positions of the blade of the first work vehicle and the sensed plurality of positions of the first work vehicle during the first maintenance pass, where the stored maintenance pass is indicative of a position of the blade associated with a position of the vehicle during the first maintenance pass for the plurality of positions of the vehicle. Performing the second maintenance pass includes performing it on the unpaved road with a second work vehicle, and performing it after the first maintenance pass. Performing the second maintenance pass includes altering the surface of the road using a blade of the second work vehicle, where a position of the blade of the second work vehicle is automatically controlled during the second maintenance pass by a controller using the stored maintenance pass and a current position of the second work vehicle. In embodiments of this method, the first and second work vehicle may be the same work vehicle or may be different work vehicles.

For the method of maintaining the road, using the stored maintenance pass may include determining a target blade position and controlling the blade actuators to move the blade toward the target blade position. Determining the target blade position may be done using the most proximate data point, interpolating between data points, or using the data point associated with a future vehicle position, as described above.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

At least one example embodiment of the subject matter of this disclosure is understood by referring to FIG. 1 through FIG. 4 of the drawings.

Figure 1:
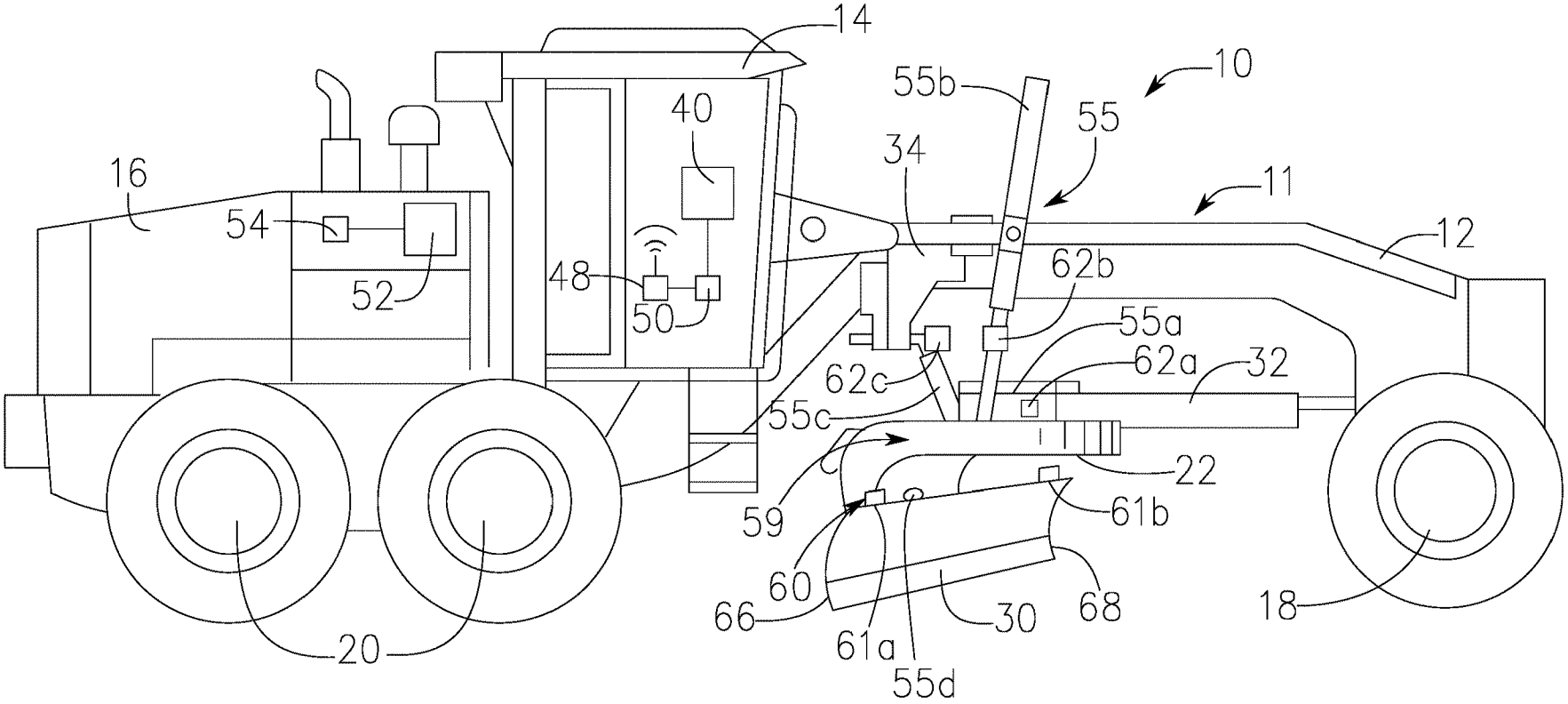
FIG. 1 is a right side view of a work vehicle in the form of a motor grader with a ground-engaging blade.

FIG. 1 illustrates a work vehicle 10. While a motor grader is used as the work vehicle in this illustrated embodiment, one skilled in the art will recognize this disclosure may be adapted for use in other types of work vehicles, including, for example, a compact track loader, crawler dozer, or skid steer. As such, the present disclosure should not be limited to applications associated with motor graders or the particular example motor grader shown and described.

The work vehicle 10 includes a chassis 12 supporting an operator station 14 and a powerplant 16 (e.g., diesel engine, electric motor) operably coupled to power a drivetrain. The chassis 12 is supported by ground-engaging steered wheels 18 at the front of the work vehicle 10 and by two pairs of tandem drive wheels 20 at the rear of the work vehicle 10. The powerplant 16 may power a hydraulic circuit described in more detail below. The chassis 12 has an articulation joint between the operator station 14 and powerplant 16 that allows the front section of the chassis 12 to pivot relative to the rear section of the chassis 12, such as during a turning operation, to shorten the effective wheelbase, and thus the turning radius, of the work vehicle 10. The articulation joint may be pivoted by one or more associated hydraulic actuators (not shown).

A circle 22 and a ground-engaging blade 30 is mounted to the front section of the chassis 12 in front of the operator station 14 by a drawbar 32 and a lifter bracket 34, which in certain embodiments may be pivotal with respect to the chassis 12 or otherwise movable into different orientations. The powerplant 16 may power one or more hydraulic pumps 52, which pressurize hydraulic fluid in a hydraulic circuit including various electro-hydraulic control valves 54, and various hydraulic actuators 55 for the blade 30. In some embodiments, for example, the work vehicle may include an implement that is not a blade, such as a scarifier, ripper, bucket, box blade, or other known implement.

In the illustrated example, the actuators 55 are a rotating hydraulic drive and linear actuators, such as one or more hydraulic cylinders. The actuators 55 include a hydraulic motor 55*a* for rotating the circle 22 about a generally vertical axis to set the steer angle of the blade 30. The actuators 55 also include lift cylinders 55*b* for raising and lowering the circle 22 and thereby the blade 30, and setting the toe-to-heel slope of the blade 30, a shift cylinder 55*c* for shifting the blade 30 laterally, and a pitch cylinder 55*d* for setting the pitch angle of the blade 30. In other configurations, other movements of the blades 30 may be possible. Further, in some embodiments, a different number or configuration of hydraulic cylinders or other actuators (e.g., pneumatic actuators, electric motors, etc.) may be used. Thus, it will be understood that the configuration of the work vehicle 10, the circle 22, and the blade 30 are presented as an example only.

As noted, the work vehicle 10 includes one or more pumps 52, which may be driven by the powerplant 16 of the work vehicle 10. Hydraulic flow from the pumps 52 may be routed through the control valves 54 and selectively sent via various conduits (e.g., hoses, pipes) in order to drive the hydraulic drives and cylinders 55*a*-55*d*. Flow from the pumps 52 may also power various other components of the work vehicle 10. The flow from the pumps 52 may be controlled in various ways (e.g., through control of the control valves 54) in order to control actuation of the hydraulic drives and cylinders 55*a*-55*d*, and thus, movement of the blade 30 relative to the chassis 12. In this way, for example, movement of the blade 30 into various orientations may be implemented by various control signals to the pumps 52 and the control valves 54.

The operator station 14 provides an enclosure for an operator seat and an operator console for mounting various control devices (e.g., steering wheel, accelerator and brake pedals, levers and joysticks), communication equipment and other instruments used in the operation of the work vehicle 10. The control devices include an operator interface 40 providing input controls and feedback. The operator interface 40 may be configured in a variety of ways. In some embodiments, the operator interface 40 may include one or more joysticks, various switches or levers, one or more buttons, a touchscreen interface that may be overlaid on a display, a keyboard, a speaker, a microphone associated with a speech recognition system, or various other human-machine interface devices.

In certain embodiments, control inputs from the operator interface 40 may be velocity inputs providing corresponding velocity-based outputs to control the control valves 54. As one of skill in the art will appreciate, certain velocity-based input and output control scheme may track not only the direction of the control input, but also the magnitude of its displacement from a neutral position, to provide the operator with a way to input both a direction and velocity command for an actuator. The velocity inputs corresponding to a desired movement of a portion of the work vehicle 10 or an actuator, possibly in conjunction with inputs from sensors or other actual position-indicating devices, to command one or more target actuator velocities (e.g., depending on the number of actuators required to effect the desire movement) to effectuate the end movement. Alternatively, the control inputs may correspond to position-based input and output control scheme where positions or displacements of the control inputs are mapped to particularly positions or displacements of a portion of the work vehicle 10 or one of its actuators, with adjustments possible according to other sensors and control algorithms.

The operator interface 40 is operatively connected to one or more controllers, such as controller 50. The operator interface 40 provides control inputs to the controller 50, which cooperates to control various ones of the associated control valves 54 to actuate the various drives and actuators 55*a*-55*d* of the hydraulic circuit. The controller 50 may provide operator feedback inputs to the operator interface 40 for various parameters of the machine, implement(s) or other sub-systems. Further, the operator interface 40 may act as an intermediary between other operator controls and the controller 50 to set, or allow the operator to set or select, the mapping or functionality of one or more of controls (e.g., switches or joystick movements) of the operator controls.

The controller 50 (or others) may be configured as a computing device with associated processor devices and memory architectures, as a hard-wired computing circuit (or circuits), as a programmable circuit, as a hydraulic, electrical or electro-hydraulic controller, or otherwise. As such, the controller 50 may be configured to execute various computational and control functionality with respect to the work vehicle 10 (or other machinery). In some embodiments, the controller 50 may be configured to receive input signals in various formats (e.g., as hydraulic signals, voltage signals, current signals, and so on), and to output command signals in various formats (e.g., as hydraulic signals, voltage signals, current signals, mechanical movements, and so on).

The controller 50 may, thus, send control signals to the actuators 55 for changing and controlling the position of the blade 30. It will be appreciated that the controller 50 may also send control signals to the powerplant 16, an accelerator, a braking system, and the like for changing the velocity of the work vehicle 10. Moreover, the controller 50 may send control signals to a steering system associated with the steered wheels 18 for changing the steering direction of the work vehicle 10 or actuators changing the articulation angle of the front section of the chassis 12 relative to the rear section.

The term "position" will be used to describe the position (or posture or orientation) of an implement, such as a grading blade or moldboard. This position can be relative to the chassis 12 of the work vehicle 10 on which the blade 30 is mounted, as it is used with the embodiment shown in FIG. 1-4, or relative to a reference point separate from the work vehicle 10 such as would be used in a GNSS ("Global Navigation Satellite System," e.g., GPS, GLONASS, Galileo, and/or BeiDou). As an example of the later, if a reference point separate from the work vehicle 10 is used, the position of the blade 30 will change as the work vehicle 10 is driven, even if the blade actuators 55 are not extending or retracting.

The controller 50 may be in electronic, hydraulic, mechanical, or other communication with the actuators 55 and/or other systems or devices of the work vehicle 10 (or other machinery). For example, the controller 50 may be in electronic or hydraulic communication with various actuators, sensors, and other devices within (or outside of) the work vehicle 10, including various devices associated with the pumps 52, control valves 54, and so on. The controller 50 may communicate with other systems or devices of the work vehicle 10 in various known ways, including via a CAN bus (not shown) of the work vehicle 10, via wireless communication, hydraulic communication means, or otherwise. An example location for the controller 50 is depicted in FIG. 1. It will be understood, however, that other locations are possible including other locations on the work vehicle 10, or various remote locations.

A communication device 48 may also be provided, and the communication device 48 may enable the controller 50 to send signals to and/or receive signals between other work vehicles or remote servers. In some embodiments, the communication device 48 may provide two-way communication with corresponding communication devices on other motor graders via any suitable wireless communication/networking means, such as WiFi, Bluetooth, or other protocols. In some embodiments, the communication device 48 may also communicate with an external device, such as a Global Navigation Satellite System (GNSS), a local positioning system or local position reference point used to improve GNSS positioning, or a cellular communications network. When communicating with a GNSS or local positioning system, the communication device 48 may comprise an antenna and receiver and may be referred to (by itself or in conjunction with other components) as a vehicle positioning system configured to provide a vehicle position signal indicative of the position of the work vehicle 10. The speed and heading of the work vehicle 10 may be indicated by a signal provided by the communication device 48 (e.g., an included GNSS receiver and associated control system) or by other sensing methods (e.g., a compass and wheel speed sensors), either of which may be referred to as a speed sensing system or a heading sensing system, or when combined, a velocity sensing system.

One or more sensors 59 may also be provided to observe and detect various parameters associated with the blade 30 of the work vehicle 10 in order to provide a signal indicative of a position of the blade 30. The sensors 59 may be referred to as a blade sensing system. In some embodiments, the sensors 59 may be angular, linear, or acceleration sensors attached to portions of the circle 22, drawbar 32, lifter bracket 34, and the blade 30 so that collectively with a kinematic model, the signals from the sensors 59 can be used to indicate the position of the blade 30. In other embodiments, the sensors 59 may include a GNSS 60 with one or two transceiver units mounted directly to the blade 30. In the illustrated embodiment, for example, the GNSS 60 may include a first GNSS transceiver unit 61*a* mounted in a predetermined position relative to a first end 66 of the blade 30. The GNSS 60 may also include a second GNSS transceiver unit 61*b* mounted in a predetermined position relative to an opposite second end 68 of the blade 30. The transceiver units 61*a*, 61*b* may be connected to the controller 50 and the communication device 48 in some embodiments. Various other sensors 59, such as additional sensors 62*a*-62*c* for the blade 30 may also be disposed on or near the circle 22. In some embodiments, the sensors 62*a*-62*c* may include angle sensors to detect rotational angle orientations of the circle 22 and/or the blade 30, linear sensors to detect the "length" of an associated cylinder of the circle 22 and/or the blade 30, or microelectromechanical sensors (MEMS) that observe a force of gravity and an acceleration associated with the circle 22 and/or the blade 30.

The various components noted above (or others) may be utilized to control movement of the blade 30 via control of the movement of the one or more hydraulic actuators 55. Accordingly, these components may be viewed as forming part of the coordinated control system and method of operation of the work vehicle 10. Each of the sensors 59 may be in communication with the controller 50 via a suitable communication architecture.

Additionally, in the illustrated example, the work vehicle 10 has an Integrated Grade Control (IGC) system, which is a high-precision blade control system using GNSS and stored terrain map data. In some embodiments, the IGC system may also allow for operator control of an initial position setting, such as an initial height setting for the blade 30, and for a combination of operator and automated position control. In additional embodiments, the IGC system may allow for fully-automated position control. In either case, the height and cross-slope (i.e., the heel-toe lateral orientation) of the blade 30 may be precisely controlled to provide the prescribed grade in the work site.

In various embodiments, the controller 50 outputs one or more control signals or control commands to one or more of the actuators 55*a*, 55*b*, 55*c*, 55*d* associated with the blade 30 based on one or more of the sensor signals received from the sensors 59 and/or input received from the operator interface 40, and further based on the coordinated control system and method of the present disclosure. The controller 50 outputs the one or more control signals or control commands to the pumps 52 and/or control valves 54 associated with the actuators 55*a*-55*d* based on one or more of the sensor signals received from the sensors 59 and input received from the operator interface 40.

Figure 2:
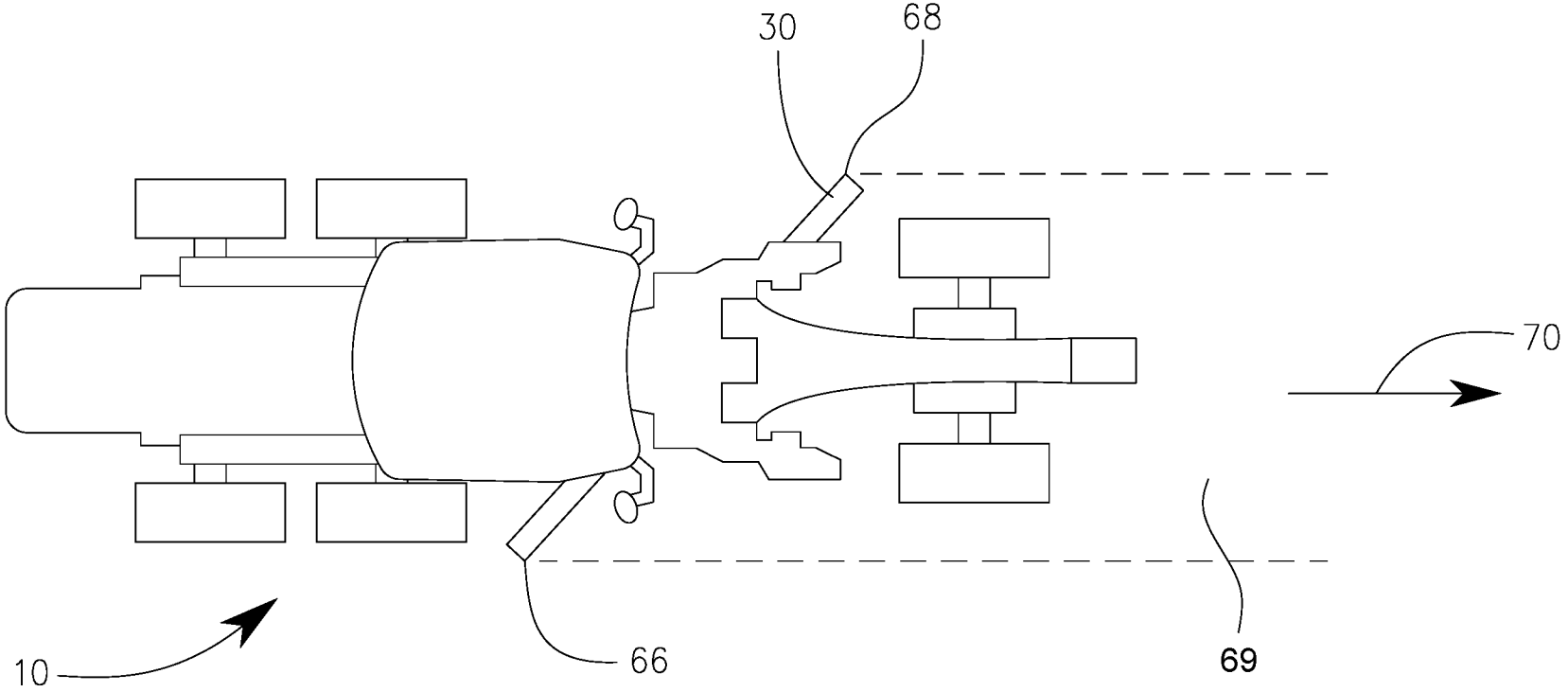
FIG. 2 is a top view of the motor grader.
Figure 3:
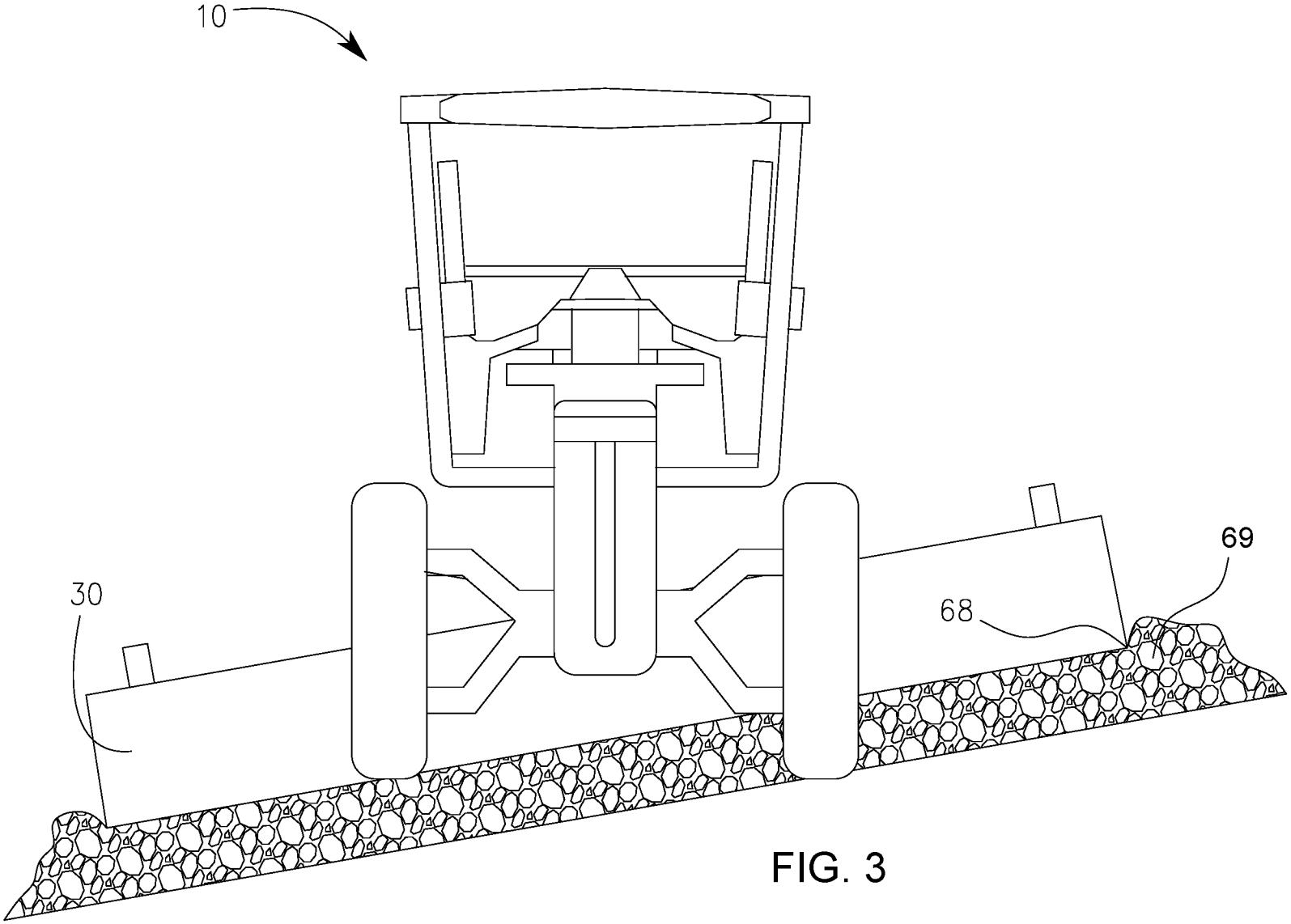
FIG. 3 is a front view of the motor grader.

Referring to FIG. 2 and FIG. 3, the work vehicle 10 may travel forward along an unpaved road 69 on a first path as indicated by arrow 70 to perform a maintenance pass on the road 69. During this maintenance pass, the work vehicle 10 uses the ground-engaging blade 30 to alter the surface of the road in order to improve the road's functionality for usage by traffic. Changing a surface of the road means altering the topography of the surface in some manner, by moving, adding, or subtracting material such that the shape and elevation of at least portions of the surface of the road is changed. Examples include spreading gravel, reshaping the crown, filling holes or lowering raised areas.

Although referred to here as a "maintenance" pass, this pass may occur during the construction, maintenance, or rehabilitation of a road. During construction, it may be spreading an aggregate on the surface of the otherwise complete road. During maintenance, it may be smoothing or shaping the road surface to keep the proper crown, equalize the distribution of aggregate, and repair minor defects. During rehabilitation, it may be cutting a new crown, spreading a significant addition of aggregate, or repairing major defects.

An operator in the operator station 14 may utilize the operator interface 40 to control the position of the blade 30 while the work vehicle traverses the road 69 along a path 70. As one example, the operator may actuate one or more levers or joysticks included in the operator interface 40, controller 50 senses those command inputs and uses them to form commands signals it sends to the hydraulic pumps 52 and control valves 54, which in turn direct hydraulic flow to actuate the actuators 55 to move and position the blade 30 as commanded by the operator. The operator may also control the speed of the work vehicle 10, for example through accelerator and brake pedals. In this way, the operator manually controls the position of the blade 30 during the course of the maintenance pass, for example to spread new gravel along the unpaved road 69 while maintaining the proper crown and cross-slope of the road (see FIG. 3). The productivity of the work vehicle 10 for this task is a function of both the conditions during the maintenance pass as well as the skill of the operator manually controlling the work vehicle 10. An operator less familiar with the work vehicle 10 or how to perform a maintenance pass may need to operate it more slowly to achieve the same job quality, and may not be able to achieve the same quality if he or she is unable to keep the blade 30 in the position which achieves an optimal road profile (e.g., crown/cross-slope) throughout the length of the road 69.

One alternative to manual control by the operator is to have a topographic map of the intended shape of the road 69 loaded into the controller 40 or operator interface 40, or accessible to the controller 50 via the communication device 48 from a remote server, and have the controller 50 automatically control (i.e., change) the position of the blade 30 throughout the maintenance pass. This topographic map may be created at the time the road 69 was built by recording points along the surface of the road as it was produced, or having a surveying crew or vehicle later measure and record such points, and then utilizing these points with software that can take them and create a topographic map of the road. The work vehicle 10 may then be driven by the operator along the path 70 while the controller 50 determines position of the vehicle from the GNSS, locates that position on the topographic map to determine the surface profile in that location, determines the position of the blade 30 which will produce that surface profile, and then commands the pumps 52 and control valves 54 to achieve that position for the blade 30. In this way, the controller 50 is automatically controlling the position of the blade 30 throughout the maintenance pass, instead of an operator actuate user controls to move and position the blade 30. Often, a system fully automatically controlling the blade 30 of the work vehicle 10 will utilize an embodiment with a first GNSS transceiver unit 61*a* on one side of the blade 30, and a second GNSS transceiver unit 61*b* on the opposite side of the blade. Such a system may be referred to as a grade control system.

Figure 4:
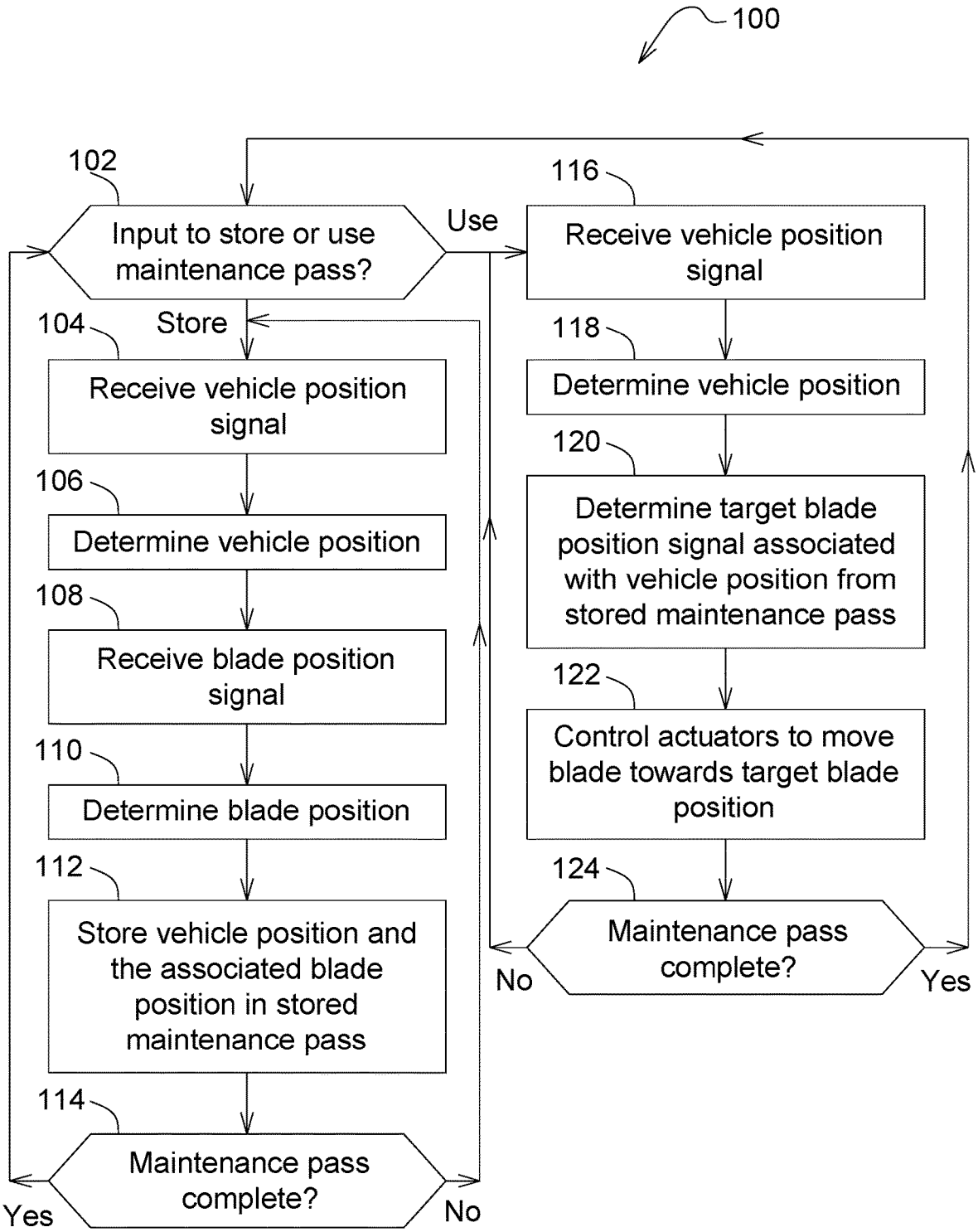
FIG. 4 is a flow diagram showing a process for recording and using a stored maintenance pass.

FIG. 4 illustrates the control system 100, which is an alternative to manually controlling the work vehicle 10 for each maintenance pass or using a grade control system, which is a control system 100 for storing and using a maintenance pass. In the embodiment illustrated in FIGS. 1-3, the control system 100 is stored and executed on the controller 50.

In step 102, the controller 50 awaits an input, for example from the operator, from another control system, or a remote command to store a new maintenance pass or use an existing maintenance pass. The operator may provide such input via the operator interface 40, for example by pressing a particular switch or by navigating to a menu on a display where the option to use a stored maintenance profile is offered. If there operator intends to do multiple maintenance passes to the road, the operator may chose to store the new maintenance pass just during the final pass so as to represent the most final and complete shape of the road. As an alternative to the operator providing the input for step 102, another control system, executing on controller 50 or executing elsewhere, may also provide the input, for example if the other control system is monitoring the position of the work vehicle 10 and engages the usage of a stored maintenance pass when the work vehicle 10 arrives within a threshold distance of a set point such as the start of a stored maintenance pass. The input may be provided by a remote command, for example by a fleet manager relaying the command to start using the stored maintenance pass via a cellular message which is received by the communication device 48. If the input is to store a new maintenance pass, the controller 50 proceeds to step 104. If the input is to use an existing maintenance pass, the controller 50 proceeds to step 116.

In step 104, the controller 50 receives the vehicle position signal from the vehicle positioning system, in this embodiment a GNSS receiver included in the communication device 48. In step 106, the controller 50 determines the position of the vehicle 10 using this received vehicle position signal. In this embodiment, the GNSS receiver regularly transmits a CAN message to the controller 50 indicating the latitude and longitude of the work vehicle 10 (e.g., 41.472883, −90.426074), but in other embodiments, the controller 50 may further process the signal it receives from the GNSS receiver to arrive at a global position. Once the vehicle position is determined in step 106, the controller 50 proceeds to step 108.

In step 108, the controller 50 receives the blade position signal from the blade sensing system, in this embodiment the sensors 59. In step 110, the controller 50 determines the position of the blade 30 by using the blade position signal and a kinematic model of the blade 30 and its supporting structure, including the circle 22, the drawbar 32, the lifter bracket 34, and the actuators 55. For example, this position may be represented as (0, −50, 0, 0, 30, 0), where the first three numbers are three linear coordinates and the second three numbers are three angular coordinates which collectively define the position of the blade relative to a neutral point. In alternate embodiments, GNSS 60 may be the blade sensing system and the controller 50 may determine the position of the blade 30 by using the blade position signal comprised of a signal from the first GNSS transceiver unit 61*a* and a signal from the second GNSS transceiver unit 61*b*. While the controller 50 is receiving blade position signals and determining the position of the blade 30, the operator of the work vehicle 10 is manually controlling the blade 30 during the maintenance pass. This operator may control the blade 30 in a number of ways, for example the operator many manually control each aspect of the position of the blade 30, or the work vehicle 10 may include a feature to automatically control the cross-slope of the blade, while the operator controls height and multiple angles. Once the blade position is determined in step 110, the controller 50 proceeds to step 112.

In step 112, the controller 50 stores the vehicle position determined in step 106 and the associated blade position determined in step 110 in a stored maintenance pass. In the example given for this embodiment, this may be represented as (41.472883, −90.426074, 0, −50, 0, 0, 30, 0), which is the vehicle position followed by the blade position at that vehicle position. This may be referred to as one record or data point in the stored maintenance pass. In alternate embodiments, the information may be encoded or stored differently, or additional parameters may be stored in the same record, such as the vehicle's speed, the vehicle's acceleration, the angle of the steered wheels 18, or the articulation angle of the chassis 12. The stored maintenance pass may also be stored locally on the controller 50, on other media on the work vehicle 10, and/or on a remote server accessible via the communication device 48, or copied or transmitted to or from any such locations after storing the maintenance pass is complete. Once this point is recorded in the stored maintenance pass, the controller 50 proceeds to step 114.

In step 114, the controller 50 determines whether the maintenance pass is complete. The controller 50 may determine this in the same manner in which it determined that a new maintenance pass should be stored in step 102, or it may utilize an alternate method such as determining when the work vehicle 10 or the blade 30 have come to a stop for more than a threshold period of time. If the maintenance pass is not complete, the controller 50 proceeds to step 104 to repeat the process of creating a new point in the stored maintenance pass. If the maintenance pass is complete, the controller 50 proceeds to step 102 where it resumes cycling until it receives new input to store or use a maintenance pass.

If the controller 50 receives the input to use a maintenance pass in step 102, it proceeds to step 116 in which it receives the vehicle position signal, similar to step 104. It then proceeds to step 118 where it determines the position of the vehicle, similar to step 106. It then proceeds to step 120 where it uses the determined vehicle position.

In step 120, the controller 50 uses the vehicle position determined in step 118 to determine a target blade position using a stored maintenance pass. The stored maintenance pass may be stored locally on the controller 50 and retrieved during this step, or retrieved from another storage media located on the work vehicle 10, or it may be stored at a remote server and loaded into the controller 50 via the communication device 48. Once the stored maintenance pass is accessible, the controller 50 may use it to determine the target blade position. In one embodiment the most proximate point may be used, where the controller 50 looks up the determined vehicle position in the stored maintenance pass, finds the nearest stored vehicle position and uses the associated stored blade position for that stored vehicle position as the target blade position. In another embodiment an interpolated value may be used, where the controller 50 may look up the determined vehicle position in the stored maintenance pass, and set the target blade position to an interpolated value using the nearest two stored vehicle positions and their associated stored blade positions. In another embodiment a predictive value may be used, where the controller 50 may use the determined vehicle position and the velocity of the work vehicle 10 (for example, determined using GNSS or wheel speed and vehicle direction) to forecast a future position of the work vehicle 10, and look up this future vehicle position in the stored maintenance pass and use its associated blade position (the most proximate point, an interpolated value, or another common lookup technique) for the target blade position. Once a target blade position is determined, the controller 50 proceeds to step 122.

In step 122, the controller 50 controls the actuators 55 to move the blade 30 toward the target blade position determined in step 120. In this embodiment, the controller 50 commands the pumps 52 to increase their swash to make pressurized hydraulic fluid available to the control valves 54. The controller 50 also sends current to solenoids in the control valves 54 causing them to actuate spools within the valves and selectively transmit the pressurized hydraulic fluid received from the pumps 52 to certain of the actuators 55, which in turn causes the blade 30 to move relative to the chassis 12 as intended by the controller 50. The controller 50 may command movement of the blade 30 in any number of fashions, such as by a feedforward algorithm or a feedback algorithm. In one embodiment, step 122 may involve the controller 50 commanding movement of the blade 30, determine an updated blade position based on a blade position signal from the sensors 59, and then issuing new commands until the position of the blade 30 is determined to be within a threshold distance of the target blade position. In such an embodiment, step 122 may run in parallel to steps 116, 118, 120, and 124, constantly seeking the target blade position even as the other steps update that blade position as the vehicle position changes.

In step 124, the controller 50 determines whether the maintenance pass is complete. In this embodiment, the controller 50 completes step 124 by considering the maintenance pass complete when the determined vehicle position from step 118 is within a threshold distance of the last vehicle position in the stored maintenance pass. In alternate embodiments, the controller 50 may make this determination differently, such as by relying on an operator or another control system indicating that the stored maintenance pass is complete, or waiting until the work vehicle 10 or the blade 30 has not moved for a threshold period of time. If the maintenance pass is complete, the controller 50 returns to step 102 (and ceases step 122 if that step is continually operating in parallel) and awaits further input regarding storing or using a maintenance input. If the maintenance pass is not complete, the controller 50 returns to step 116.

In alternate embodiments, additional information may be provided to the operator, for example through the operator interface 40, while the controller 50 is automatically controlling the position of the blade 30 using the stored maintenance pass. One example is that the vehicle speed, engine speed, gear, or similar information is also included in the stored maintenance pass for each vehicle position, such that this information can be displayed for the operator to provide further understanding of the operating parameters when the maintenance pass was created. Another example is that the controller 50 may communicate with the operator interface 40 to display the position of the blade 30 that it is targeting using the stored maintenance pass, to give the operator a better feel for what the controller 50 is automatically doing while the operator controls the velocity of the work vehicle 10. The display could be of the current blade position, or it could be of a target blade position that the controller 50 is moving toward. The display could also depict the surrounding environment for the blade 30, for example where the blade 30 is positioned relative to the center or edge of the road, or the estimated cross-sectional shape of the road at the current or a future vehicle position.

In the embodiment illustrated and described with reference to FIG. 4, the stored maintenance pass consists of a series of data points of blade positions associated with the vehicle position at the time that blade position was sensed. In alternate embodiments, the stored maintenance record could be processed further, or the sensed blade and vehicle positions used directly, to create a topographical map of the presumed surface of the road. This topographical map may assume that the surface of the road was just beneath the cutting edge of the blade through the maintenance pass and use this assumption to create a three-dimensional surface of the road connecting the data points in the stored maintenance pass. This topographical map could then be used for later maintenance passes on the same road, or analysis could be completed on the topographical map to measure certain parameters of the road. For example, the crown or cross-slope of the road may be calculated for multiple points along the topographical map, and if an aspect of the cross-section appears outside of a target range (e.g., the cross-slope is below or above a threshold), that portion of the road may be flagged for additional maintenance, such as additional fill or an additional maintenance pass to remove or spread material further. In certain embodiments of this alternative, the stored maintenance pass may be uploaded from the work vehicle 10 to a remote server via the communicate device 48, and then the remote server may process the stored maintenance pass to create the topographical map and perform any additional analysis on the map to identify areas outside of a target range.

Without in any way limiting the scope, interpretation, or application of the claims appearing below, a technical effect of one or more of the example embodiments disclosed herein is to improve the quality of a maintenance pass on an unpaved road and/or improve the productivity of a work machine performing a pass. The example embodiments illustrated and described provide a way to store and use a maintenance pass, which may be done by an experienced or expert operator, such that it can be used for later maintenance passes on that same road, without the additional complexity, cost, and delay of creating a full topographical map of the road and then using a grade control equipped work vehicle to perform the maintenance pass.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the work vehicles and the control systems and methods described herein are merely exemplary embodiments of the present disclosure.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

a vehicle positioning system configured to provide a vehicle position signal indicative of a position of the vehicle;

a ground-engaging blade moveable by blade actuators;

a blade sensing system configured to provide a blade position signal indicative of a position of the blade;

a speed sensing system configured to provide a vehicle speed signal indicative of a speed of the vehicle;

a heading sensing system configured to provide a vehicle heading signal indicative of a heading of the vehicle; and a controller in communication with the vehicle positioning system, the blade actuators, and the blade sensing system, the controller configured to:

receive the vehicle position signal;

receive the blade position signal;

receive the vehicle speed signal;

receive the vehicle heading signal;

determine a future vehicle position using the vehicle position signal, the vehicle speed signal, and the vehicle heading signal;

determine a target blade position using the vehicle position signal and a stored maintenance pass, the stored maintenance pass indicative of a past position of the blade associated with a past position of the vehicle for a plurality of past vehicle positions;

determine the target blade position using the future vehicle position and the stored maintenance pass; and control the blade actuators to move the blade toward the target blade position.

2. The work vehicle of claim 1, wherein the controller is further configured to:

use a plurality of vehicle position signals and a plurality of blade position signals to create a new maintenance pass; the new maintenance pass indicative of the position of the blade associated with the position of the vehicle for a plurality of positions of the vehicle.

3. The work vehicle of claim 1, wherein the controller is further configured to:

determine a current vehicle position using the vehicle position signal;

determine the target blade position using the stored maintenance pass by selecting the past position of the blade associated with the past position of the vehicle most proximate to the current vehicle position.

4. The work vehicle of claim 1, wherein the controller is further configured to:

determine a current vehicle position using the vehicle position signal;

determine the target blade position using the stored maintenance pass using interpolation applied to two past positions of the blade associated with the two past positions of the vehicle most proximate to the current vehicle position.

5. The work vehicle of claim 1, wherein the vehicle is a motor grader.

6. A method of maintaining an unpaved road comprising:

performing a first maintenance pass on the unpaved road with a first work vehicle under the manual control of an operator, the first maintenance pass altering a surface of the road using a blade of the first work vehicle;

sensing a plurality of positions of the blade of the first work vehicle during the first maintenance pass;

sensing a plurality of positions of the first work vehicle during the first maintenance pass;

creating a stored maintenance pass using the sensed plurality of positions of the blade of the first work vehicle and the sensed plurality of positions of the first work vehicle during the first maintenance pass, the stored maintenance pass indicative of a position of the blade associated with a position of the vehicle during the first maintenance pass for the plurality of positions of the vehicle; and performing a second maintenance pass on the unpaved road with a second work vehicle, the second maintenance pass performed after the first maintenance pass, the second maintenance pass altering the surface of the road using a blade of the second work vehicle, a position of the blade of the second work vehicle automatically controlled during the second maintenance pass by a controller using the stored maintenance pass and a current position of the second work vehicle, wherein the controller determines a future position of the second work vehicle using a current position of the second work vehicle, a speed of the second work vehicle, and a heading of the second work vehicle;

the controller determines a target blade position using the stored maintenance pass by selecting a position of the blade during the first maintenance pass associated with a position of the vehicle during the first maintenance pass that is most proximate to the future position of the second work vehicle; and the controller automatically moves the blade toward the target blade position during the second maintenance pass.

7. The method of claim 6, wherein the first work vehicle and the second work vehicle are the same work vehicle.

8. The method of claim 6, wherein the first work vehicle and the second work vehicle are different work vehicles.

9. The method of claim 6, wherein:

the controller determines a current position of the second work vehicle;

the controller determines a target blade position using the stored maintenance pass by selecting a position of the blade during the first maintenance pass associated with a position of the vehicle during the first maintenance pass that is most proximate to the current position of the second work vehicle; and the controller automatically moves the blade toward the target blade position during the second maintenance pass.

10. The method of claim 6, wherein the first work vehicle and the second work vehicle are each a motor grader.

* * * * *